United States Patent [19]

Bourque

[11] 4,239,205

[45] Dec. 16, 1980

[54] SMALL PIECE STACKER AND COUNTER

[75] Inventor: Michel Bourque, North Berwick, Me.

[73] Assignee: B. B. & D. Associates, Biddeford, Me.

[21] Appl. No.: 30,099

[22] Filed: Apr. 16, 1979

[51] Int. Cl.[3] ..... B65H 29/24; B65H 33/08

[52] U.S. Cl. ..... 271/175; 271/177; 271/176; 271/213

[58] Field of Search ..... 271/175, 176, 188, 189, 271/190, 195, 209, 177, 184, 213, 180; 414/69, 907; 93/93 C

[56] References Cited

U.S. PATENT DOCUMENTS

| | | | |
|---|---|---|---|
| 3,169,763 | 2/1965 | Harris | 271/177 |
| 3,632,106 | 1/1972 | Schwenk | 271/175 |
| 4,099,789 | 7/1978 | Zaglio | 271/175 |

FOREIGN PATENT DOCUMENTS

| | | | |
|---|---|---|---|
| 2059394 | 6/1972 | Fed. Rep. of Germany | 271/180 |

*Primary Examiner*—R. B. Reeves
*Assistant Examiner*—Brian Bond
*Attorney, Agent, or Firm*—William Nitkin

[57] ABSTRACT

A small piece stacker and counter for use in association with laundry ironing machines comprising a conveyor belt means having space defined between two belts with passage therethrough of the piece, blow down means for the blowing down of the piece through the spaced apart conveyor belts, and catch means for the catching of the piece at a central portion thereof.

4 Claims, 4 Drawing Figures

SMALL PIECE STACKER AND COUNTER

BACKGROUND OF THE INVENTION

1. Field of the Invention

The device of this invention resides in the area of laundry folding and stacking devices and more particularly relates to an apparatus for the receipt, folding, stacking and counting of small laundered pieces particularly napkins and the like after the pressing thereof.

2. History of the Prior Art

In commercial laundries wide-throated ironers, such as 5-roll American Hydros are commonly utilized for pressing sheets and smaller articles. The ironers can feed the pressed laundry, such as sheets, into sheet-folding machines, for example a Jensen Constellation, in order to mechanically fold such sheets after the pressing thereof. Other items are also fed through these wide-throated ironers. Since many of these items are smaller than sheets and cannot be folded by sheet folding machines, currently one must have individuals at the end of the ironer to catch the pieces and fold them by hand. Often if there are a plurality of people, usually four, feeding in small pieces, such as napkins into the ironers, then there must be an equal number of individuals to receive such pieces and fold them by hand when they come out of the ironer or exit on the conveyor belts of the folder, which folder cannot be utilized for folding purposes during small piece transport operation. In an attempt to mechanize small piece handling some machines have a perpendicular bar disposed at the end of the conveyor belt, and the small pieces travel and fall onto the bar. The bar may be supported by a bracket which has the ability to tip forward upon the receipt thereon of a particular predesignated count so that the napkins or other pieces travel onto the bar, fold over the bar, one after the other on top of each other. When the number of pieces reaches the preselected count, then the bracket tips the bar forward and those pieces are retrieved off the bar. Another method of gathering such pieces is for them to free fall off the end of the conveyor belt onto bars centrally supported in metal cages approximately the size of the piece so that the pieces drape across the bar. When a desired number has fallen on the bar, they are removed by a worker.

SUMMARY

It is an object of this invention to make automatic the hand-folding and other means of gathering small pieces from laundry folding machines in order to reduce the number of workers needed to gather and fold by hand small pieces, such as napkins.

It is a further object of this invention that the number of pieces collected and folded in a particular group may be precounted by the operation of this device.

It is a further object of this invention that the device be utilizable in conjunction with existing sheet-folding machines such as the Jensen Constellation mentioned above and ironers such as the 5-roll American Hydro; and that the device be movable away from the work area so that when one wishes to use the sheet-folding machine for folding sheets or other large pieces, then one may do so without interference from the small piece handling device of this invention.

It is still yet an additional object of this invention that the device operate on air pressure which is commonly used within laundries as a means of moving pieces from place to place.

BRIEF DESCRIPTION OF THE PREFERRED EMBODIMENT(S)

Figure 1:
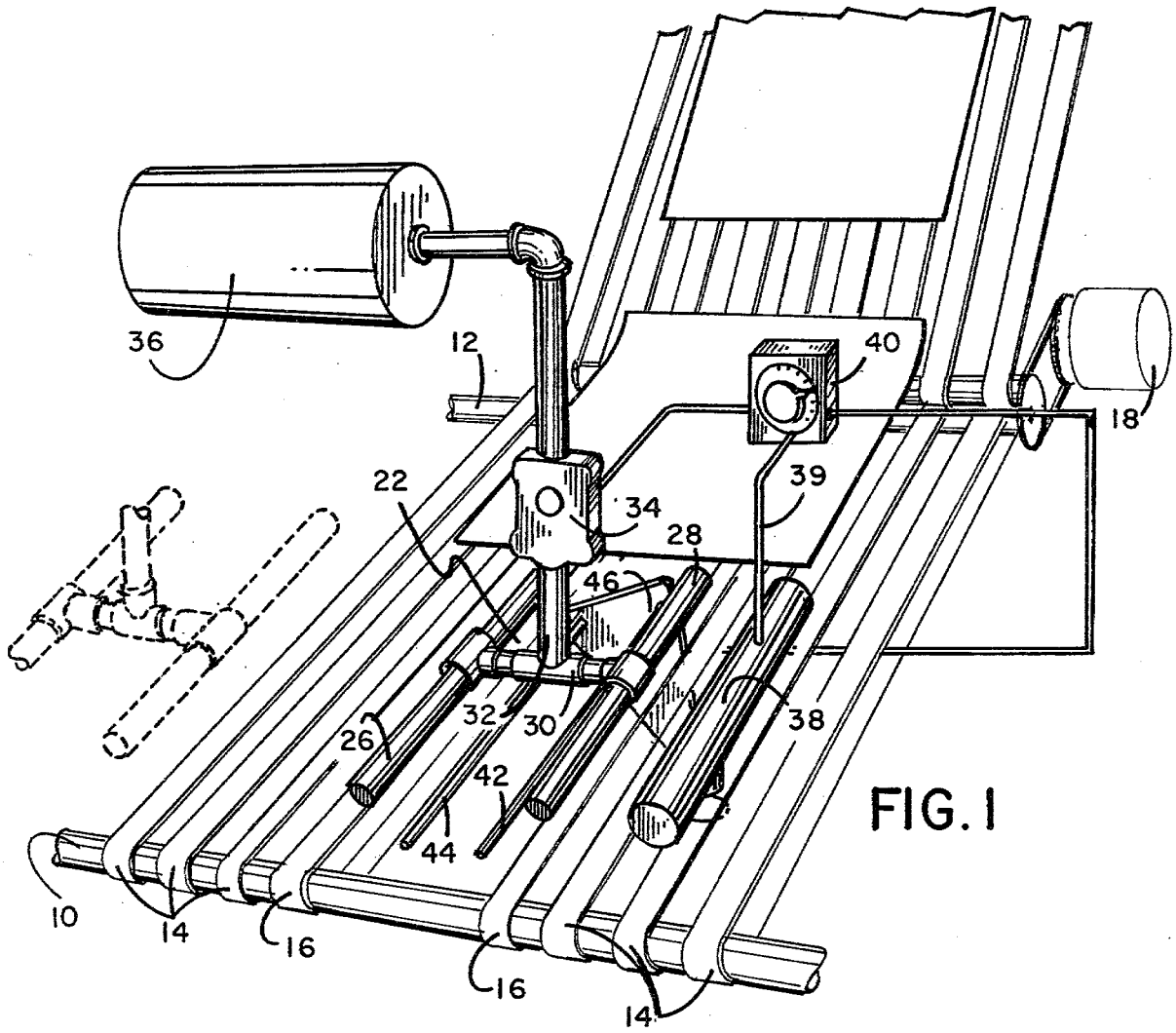
FIG. 1 is a perspective view of one device of this invention in line with others, a portion of one being shown.
Figure 2:
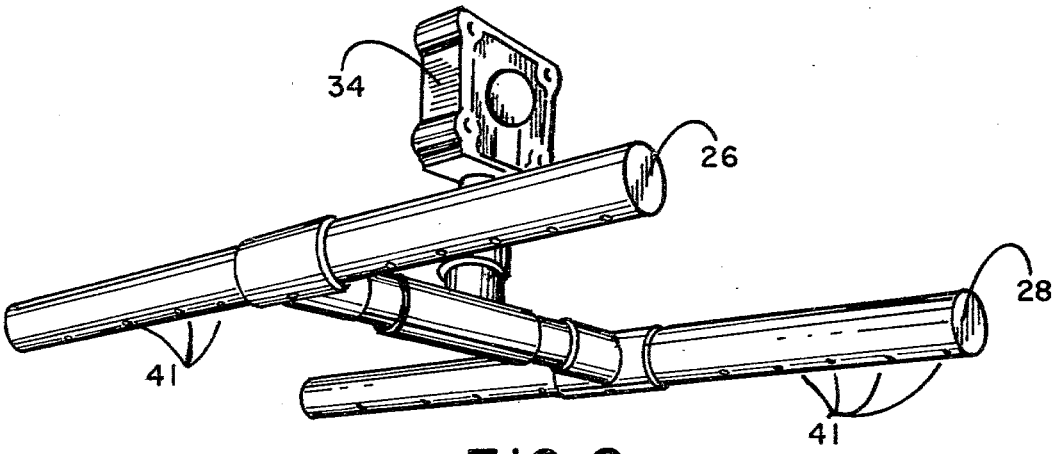
FIG. 2 is a view of the bottom of the blow-down pipes of this invention.
Figure 4:
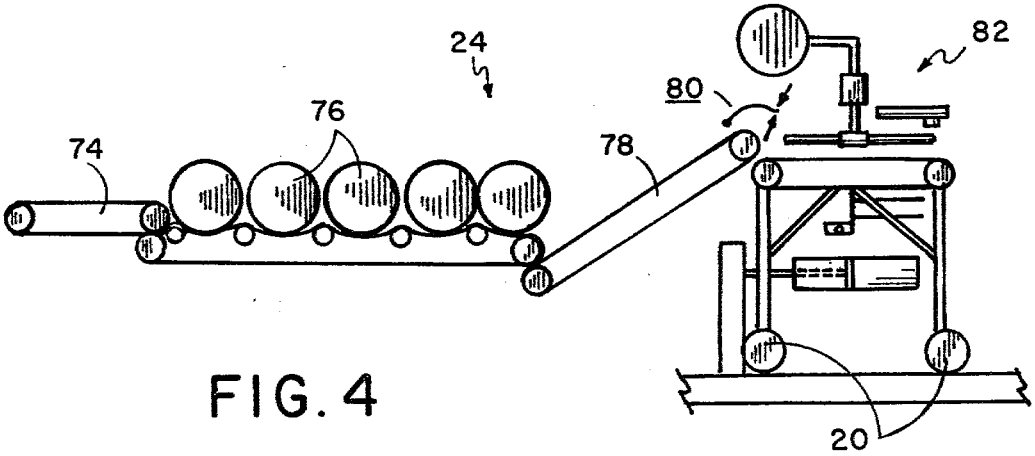
FIG. 4 is a diagrammatical view of a cross-section of the operation and relation of the device to existing machines.

FIG. 1 illustrates a perspective view of one blow-down member 22. It should be noted that a series of these members can be utilized, one of them, to the right of the blow-down member, is illustrated in outline form. There should be one blow-down member 22 for each entry point of small pieces into the ironer. Seen in this view are first roller 10 and second roller 12 spaced horizontally apart from one another and having, running therebetween, a plurality of conveyor belts 14, the innermost conveyor belts 16 on either side of the blow-down member 22 are spaced apart a particular distance, the determination of which will be discussed below. A means to drive the conveyor belts in a forward manner is provided by means such as motor 18 or equivalent means. The distance between the innermost conveyors 16 must be a distance wider than the blow-down member 22 yet narrower than the small piece, such as a napkin, to be folded, stacked and counted by the device of this invention. Approximately 7" has been found satisfactory. The blow-down member 22 is supported on a plane horizontal to the plane of the conveyor belts and somewhat above the surface upon which the piece will be transported on the conveyor belts. The device is adapted so that when the pieces are entered into the ironer 24, as seen in FIG. 4, they pass through and eventually are carried on conveyor belts 14 and 16 of the device of this invention and pass under the blow-down member 22. The blow-down member consists of first blow-down pipe 26 and second blow-down pipe 28 which are interconnected by cross pipe 30. This cross pipe is interconnected to air supply tube 32 in which the flow of air is controlled by a solenoid control valve 34 between such air supply tube 32 and an air pressure source 36. The air pressure source must be capable of producing pressure in the range of 50 psi and may consist of a compressor, a tank, reserve tank, or any equivalent well-known source of supplying such air pressure. The solenoid valve 34 is controlled to allow passage of the air pressure when the piece passes under a photocell detector 38 or any equivalent means of detection of passage of the piece along the conveyor belt at a predetermined point. When the photocell or equivalent is activated, the line 39 running therefrom activates solenoid valve 34 and interconnects the air pressure source 36 through blow-down pipes 26 and 28. In a preferred embodiment such line 39 is interconnected through counter 40. Such counter 40 can be of a conventional type able to be preset to a desired number of activations before resetting is necessary. In practice each piece proceeds along the conveyor belt and when it reaches the preselected position on the conveyor belt and is sensed by detection means 38, the solenoid valve 34 is activated, opening air pressure source 36 into the blow-down member 22, forcing the piece through the innermost conveyor belts 16 onto catch member 42 which will be more fully described below. Further each time the blow-down member 22 is activated, the counter will count that piece and will perform operations as described below when a preselected number has been reached. At the bottom of the blow-down member 22 along the first blow-down pipe 26 and second blow-down pipe 28, as seen in FIG. 2, are a series of apertures 41. These apertures can be of 1/16" in diameter and spaced approximately 1" from one another. As has been mentioned above, each time a piece passes under detector 38, it is blown downward between the innermost conveyor belts 16 onto a catch member below. The piece is blown onto the catch member so that it catches in its center and both sides thereof land down on either side of the catch member. Each piece will stack upon one another on a catch member such as 42 or 44 when it becomes positioned below the blow-down member 22 until counter 40 counts the desired number of pieces that have gone under the detector and have been blown down upon a catch member. When the desired number on the counter has been reached, the catch member is rotated by toggle means so that the other empty catch member, being the second catch member 44 illustrated in FIG. 1, rotates under the center of the blow-down member 22 for receipt of the then proceeding pieces along the conveyor belt. An operator will remove the preselected number of folded pieces which have been folded along their center over the first catch member 42 and will stack them in a place for their delivery to the customer. When the second catch member 44 has received the preselected number of pieces, then the toggle means rotate the first catch member, now emptied, back underneath the blow-down mechanism to receive successive pieces blown down thereon and a worker will remove the preselected number of pieces from the second catch member. The process continues with alternate catch members receiving the pieces.

Figure 3:
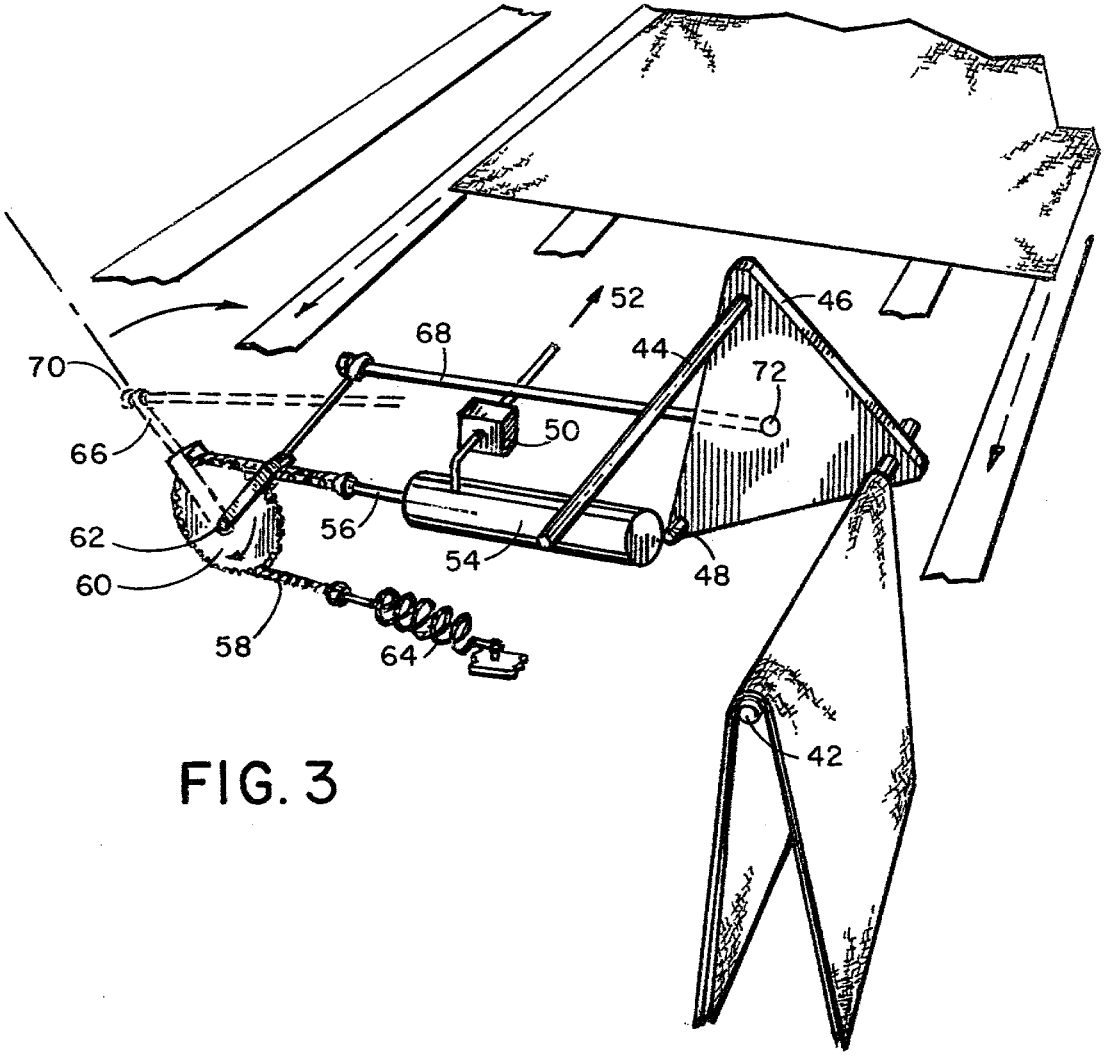
FIG. 3 is a view of the catch member and operating means thereof.

FIG. 3 illustrates a means of operating the rotation of the first catch member and second catch member into and out of position under the receiving area below the blowdown member 22. Other means can be utilized to rotate the toggle means of the first and second catch member, but it has been found that the means described below work well with the device of this invention utilizing the air pressure source that is conveniently available for use. Seen in this view are first catch member 42 and second catch member 44 which are mounted and protrude from toggle plate 46. The lengths of first catch member 42 and second catch member 44 should be sufficiently long to receive the piece being blown down thereupon. The space between catch members 42 and 44 on a diagonal should be sufficient, for example, to prevent the pieces from hitting the second catch member when they are landing on the first catch member. The toggle plate is adapted to pivot at pivot point 48 which is rotatably attached to a position on the frame of the device of this invention and is adapted so that the toggle plate when positioned at rest to the left has the first catch member centered below the blow-down member 22 and when rotated to the right, comes to a rest position so that the second catch member is centered below the blow-down member 22 for receipt of the pieces thereon. In order to rotate the toggle plate to and fro, a circuit is completed from the counter when it has reached the preselected number of pieces to be stacked which opens valve 50 from air supply 52 to piston 54 thereby pulling that piston's rod 56 to the right as seen in FIG. 3, the end of which piston rod 56 is attached to chain member 58 around sprocket member 60 affixed to one-way ratchet member 62. The other end of chain 58 is affixed to spring member 64 which is affixed at its other end to the frame of the device of this invention, so that when the piston rod is activated and moved to the right by the air pressure, the chain will rotate sprocket member 60 clockwise. Affixed to the one-way ratchet 62 is first arm 66 which when the sprocket moves also rotates clockwise to a preselected position of rotation. This action will move second arm 68 which is affixed to first arm 66 at junction 70 and to the toggle plate at junction 72, both of which junctions 70 and 72 rotate. Upon the total movement inward of the piston, the air pressure is then cut off by valve 50, and spring 64 causes the return of the piston rod to its ready position moving it out of the piston to the left. This movement though does not rotate arm 66 and its attached arm 68 due to the use of the one-way ratchet 62 which allows arm 66 only to be moved during the clockwise rotation of sprocket member 60. When the next load of pieces has been blown down on a catch member, the counter then activates valve 50 causing the air supply to enter and move the piston arm to the right again which will rotate arm 66 causing its adjoining arm 68 to push the toggle plate at junction 72 to its second operative position which allows the centering of the catch member then to be used under the blow-down member 22. It should be noted that it has been found desirable to have a certain amount of play within junction 72 of the toggle plate so that the very last portion of the movement is gravitational to the exact position of centering under the blow-down member. This allows for any deviations in pressure or movement of the sprocket member 60 and the rotational arms that might occur due to changes in pressure or spring wear so that once toggle plate 45 has been moved to a position by the second arm 68, it will just merely fall the remaining small distance to the exact point of centering below the blow-down member 22.

In FIG. 4 we see a diagrammatical cross-sectional view of an ironer, sheet folder and the device of this invention. Seen in this view is ironer 24 with its input feed rollers 74 upon which the pieces are positioned. If, for example, four blow-down members are utilized in the device of this invention in line on the rollers, then four positions for entering pieces along the input conveyor belt would be utilized. It has been found that the input of the pieces can best be accomplished by placing a mark on the appropriate belt which will, when a worker positions the piece in proper relation to the mark, cause the piece to come properly positioned for blow down when it is fed out to the device of this invention. As the piece is fed onto input rollers 74 in the proper position relating to the line indicator as mentioned above, it passes under presser rollers 76 and then, in some embodiments, will pass into the folding element of the sheet folder 78 which, in the mode to handle small pieces as mentioned above, does not perform its folding function but has gate 80 which is opened allowing the piece to just pass therethrough without any operations performed thereon. The device 82 of this invention can be rolled toward and away from the gate 80 on rollers 20 and is positioned in such a fashion as not to interfere with the folding mechanism when it is rolled out of operating position. It has been found that the device need be rolled forward only a short distance to allow for the complete operation of the sheet or other large piece folding machines and when one desires to stack and fold small pieces utilizing the device of this invention, one opens gate 80 and rolls the device of this invention back to gate 80. This movement is accomplished in a preferred embodiment by having pneumatic cylinders move the device of this invention forward so that conveyor belts 14 and 16 will catch the pieces coming off the sheet-folding conveyor 78 through gate 80. It is also noted that each drive system is a step-up system within the operation of the prior art system and with the operation of the device of this invention, that is, as the piece proceeds toward the device of this invention, each conveyor operates at a slightly faster speed so as to pull the pieces away from one another to avoid wrinkling and to cause a flattening thereof during operation. It has been found that the device of this invention can be used to fold napkins, kitchen towels, etc or pieces of a size at least as large as 22"×22" with ease and at a five-lane configuration with five blow-down members, each one interconnected to the air supply, and each one having its own counter. Such five-lane configuration has been found to cover a standard folding machine and works with good speed and efficiency since only one individual is needed to stack the folded, counter pieces after removing them from the catch member.

Although the present invention has been described with reference to particular embodiments, it will be apparent to those skilled in the art that variations and modifications can be substituted therefor without departing from the principles and spirit of the invention.

I claim:

1. A small laundry piece stacker and counter for use in association with laundry ironing machines comprising:

conveyor belt means having a space defined between an inner pair of said conveyor belts, said space being a distance less than the width of said piece;

a stationary blow-down member including elongated first and second blow-down pipes arrayed parallel to one another in a plane above said area between said inner conveyor belts aligned with the movement of the pieces, said first and second blow-down pipes each having a plurality of apertures defined at the bottom thereof;

air supply means adapted to blow air through said apertures in said blow-down pipes;

air supply control means interposed between said air supply means and said blow-down pipes;

detector means adapted to detect the positioning thereunder of a piece being moved along said conveyor belts, said detector adapted such that when it detects the presence of said piece, it activates said air supply control means thereby allowing air to pass from said air supply means through said apertures in said blow-down pipes whereby the pieces are blown down between the inner conveyor belts and catch means disposed below said blow-down pipes onto which said pieces are blown when air passes through said blown-down pipe aperatures, said first blow-down pipe being situated to one side of said catch means and said second blow-down pipe being situated to the other side of said catch means.

2. The device of claim 1 wherein said catch means comprise a first rod member and at least a second rod member which are adapted to receive a pre-selected number of pieces blown down thereon so as to be folded in a central portion thereof over each of said rod members, said rod members being affixed to a movement means adapted to move each of said rod members alternately into a central position aligned with and positioned below said blow-down member.

3. The device of claim 2 further including piece counter means adapted to control the alternation of said catch means.

4. A small piece stacker and counter comprising:

a pair of rollers;

a series of conveyor belts driven by said rollers;

an inner pair of said conveyor belts spaced apart a distance less than the width of said piece;

a blow-down member including first and second blow-down pipes arrayed in a plane above said area between said inner conveyor belts, said first and second blow-down pipes having a plurality of apertures defined at the bottom thereof;

air supply means adapted to blow air through said apertures in said blow-down pipes;

air supply control means interposed between said air supply means and said blow-down pipes;

detector means adapted to detect the positioning thereunder of a piece being moved along said conveyor belts, said detector means adapted such that when it detects the presence of said piece, it activates said air supply control means thereby allowing air to pass from said air supply means through said apertures in said blow-down pipes;

catch means disposed below said blow-down pipes onto which said pieces are blown when air passes through said blow-down pipe apertures wherein said catch means comprise a first catch member and a second catch member which are adapted to receive a pre-selected number of pieces thereon folded in a central portion thereof over each of said catch members, said catch members being affixed to a toggle plate adapted to rotate each of said catch members into a central position below said blow-down member;

counter means adapted to control the rotation of said toggle plate wherein said toggle plate is adapted to be moved into said positions centering either said first or second catch member beneath said blow-down member by a second arm member having a first and second end, said first end being rotatably affixed to said toggle plate;

a first arm member having a first and second end, said first end being rotatably connected to the second end of said second arm member;

a one-way ratchet affixed to the second end of said first arm member;

a sprocket member rotatably mounted, adapted to unidirectionally rotate said one-way ratchet;

a chain member having a first and second end, the body of which passes around said sprocket member;

an air cylinder and piston with rod, said rod connected to the first end of said chain member, said air cylinder's piston adapted to be operated by said air supply means;

valve means interposed between said air cylinder and said air supply means, said valve means adapted to be controlled by said counter means; and a spring means having a first and second end, said first end interconnected with the second end of said chain member and the second end affixed to a stationary portion of the device of this invention.

* * * * *